US009009872B2

(12) United States Patent
Chiang

(10) Patent No.: US 9,009,872 B2
(45) Date of Patent: Apr. 21, 2015

(54) SWIMMING GOGGLES

(75) Inventor: Herman Chiang, New Taipei (TW)

(73) Assignee: Global Esprit Inc., New Taipei (TW)

( * ) Notice: Subject to any disclaimer, the term of this patent is extended or adjusted under 35 U.S.C. 154(b) by 463 days.

(21) Appl. No.: 13/484,063

(22) Filed: May 30, 2012

(65) Prior Publication Data

US 2013/0283509 A1 Oct. 31, 2013

(30) Foreign Application Priority Data

Apr. 27, 2012 (TW) ..... 101208006 U

(51) Int. Cl.
*A61F 9/02* (2006.01)
*A63B 33/00* (2006.01)

(52) U.S. Cl.
CPC ..... *A63B 33/002* (2013.01); *A63B 2033/004* (2013.01); *A63B 2209/00* (2013.01)

(58) Field of Classification Search
CPC ..... A63B 33/00; A63B 33/002; A63B 2033/004; A63B 2033/006; A63B 2033/008; A61F 9/02
USPC ..... 2/426, 428, 439, 440, 442, 443, 445, 2/446
See application file for complete search history.

(56) References Cited

U.S. PATENT DOCUMENTS 6,405,384 B1 * 6/2002 Chiang ..... 2/428
7,146,653 B2 * 12/2006 Chou ..... 2/426
7,181,780 B1 * 2/2007 Chiang ..... 2/452
7,210,175 B2 * 5/2007 Chiang ..... 2/450
7,251,842 B1 * 8/2007 Chiang ..... 2/445
7,257,848 B2 * 8/2007 Chiang ..... 2/448
7,444,689 B2 * 11/2008 Chiang ..... 2/428
7,631,400 B2 * 12/2009 Chiang ..... 24/170
7,647,650 B2 * 1/2010 Chiang ..... 2/431
7,698,751 B2 * 4/2010 Chiang ..... 2/450
8,286,271 B2 * 10/2012 Chiang ..... 2/448
2006/0010585 A1 * 1/2006 Chiang ..... 2/426
2006/0015990 A1 * 1/2006 Chiang ..... 2/426
2006/0059607 A1 * 3/2006 Chiang ..... 2/428
2007/0028371 A1 * 2/2007 Chiang ..... 2/426
2007/0277297 A1 * 12/2007 Chiang ..... 2/426
2008/0134417 A1 * 6/2008 Aoyama ..... 2/431
2008/0263753 A1 * 10/2008 Chiang ..... 2/431
2009/0038060 A1 * 2/2009 Chiang ..... 2/440
2009/0038062 A1 * 2/2009 Chiang ..... 2/445
2009/0064399 A1 * 3/2009 Chou ..... 2/442
2009/0113608 A1 * 5/2009 Chou ..... 2/452
2009/0293181 A1 * 12/2009 Chiang ..... 2/428
2011/0056003 A1 * 3/2011 Chen ..... 2/440
2011/0219523 A1 * 9/2011 Chiang ..... 2/434

* cited by examiner

*Primary Examiner* — Alissa L Hoey
(74) *Attorney, Agent, or Firm* — Cheng-Ju Chiang

(57) ABSTRACT

The present invention is to provide swimming goggles including left and right frames, a connecting element interconnecting the left and right frames, padding portions, and buckling devices respectively attached to outer sides of the left and right frames for connecting and guiding a head strap, wherein the connecting element has left and right portions for integrally covering inner sides of the left and right frames. The connecting element has flexibility to allow the connecting element to be perfectly fitted to a user's nose bridge. Furthermore, flexible elements are disposed between the buckling devices and outer sides of the left and right frames to allow the swimming goggles to be fitted to the user's face. Accordingly, the swimming goggles are ergonomically designed and provide comfort in wearing without water leakage.

9 Claims, 6 Drawing Sheets

SWIMMING GOGGLES

BACKGROUND OF THE INVENTION

1. Field of the Invention

The present invention relates to swimming goggles, and particularly to swimming goggles being designed ergonomically and leak-proof so as to provide comfort in wearing.

2. Related Art

In general, swimming goggles are able to be classified into a separate type and integral type according to how left and right frames thereof are connected. Specifically, the separate type is to utilize a connecting structure to connect the left and right frames, while the integral type is to integrally shape the left and right frames and a connecting element all together. With respect to the separate type, the connecting structure is made of rigid material which hardly provides any flexibility. As a result, such rigid connecting structure makes users uncomfortable in wearing, especially for a user having a high nose bridge. Moreover, because of lack of flexibility, the connecting structure may cause an unfitting contact between the left and right frames and a user's face, and further give rise to a problem of leakage. With respect to the integral type, rigid material is also required to be used to integrally shape the left and right frames and the connecting element so as to prevent lenses from being disengaged because of a pulling force generated when wearing of swimming goggles. It is clear that the integral type of swimming goggles has the same problem as the separate type that the rigid connecting element lacking flexibility could make a user uncomfortable, especially for a user having a high nose bridge, and cause water to leak into eyes. Therefore, traditional separate and integral types of swimming goggles fail to perfectly fit onto different profiles of faces and protect swimming goggles from water leakage.

Furthermore, buckles of traditional swimming goggles for connecting a head strap are directly attached to left and right frames, and therefore positions of the buckles are limited. As a result, the buckles may also cause a user uncomfortable without keeping an appropriate distance from the left and right frames, especially for a user having a larger profile of face.

SUMMARY OF THE INVENTION

Accordingly, an object of the present invention is to provide swimming goggles capable of being fitted to a user's nose bridge and face so as to provide comfort in wearing without water leakage.

To achieve the above-mentioned object, the swimming goggles of the present invention comprises left and right frames, a connecting element interconnecting the left and right frames, padding portions, and buckling devices respectively attached to outer sides of the left and right frames for connecting and guiding a head strap; wherein the left and right frames each comprises a clamping frame having an inner rim and an outer rim, a clamping notch formed on the inner rim, a cutout portion defined at an inner side of the outer rim, a slit formed at an outer side of the outer rim and transversely penetrating the outer and inner rims, and a penetrating channel defined on the outer side of the outer rim, the penetrating channel penetrating the outer rim and the slit and being perpendicular to the slit; the connecting element having a central portion and left and right portions, the left and right portions integrally covering the cutout portions of the clamping frames, respectively; each of the padding portions comprising a contact portion and a fixing portion, the contact portion integrally laterally extending from the fixing portion, the fixing portion having an inner groove for fixing a lens, and an outer lip portion for being held in the clamping notch of the clamping frame; and each of the buckling devices comprising a buckling body at least defining a guiding cavity thereon, a first connecting element inserted into the penetrating channel of the clamping frame, and a flexible element integrally connecting the left and right frames and the buckling body.

With the above-mentioned structures, the swimming goggles are fitted to a user's nose bridge and face with the left and right portions of the connecting element, and the flexible element.

In accordance with the present invention, the cutout portion of the clamping frame has a plurality of protrusions protruding outwardly of the cutout portion for facilitating a better grip when being integrally shaped with the left and right portions of the connecting element.

Further in accordance with the present invention, a first dent portion is formed at a side of the buckling body facing the flexible element, and has a plurality of ribs protruding outwardly for facilitating a better grip when being integrally shaped with the flexible element.

Further in accordance with the present invention, the buckling device further comprises a second connecting element which is shaped as a cap being hollow inside, the cap having inner and outer profiles and a through hole which corresponds to the penetrating channel and penetrates the inner and outer profiles. Moreover, the outer profile of the cap has a second dent portion formed at a side of the cap facing the flexible element, the second dent portion having a plurality of ribs protruding outwardly for facilitating a better grip when being integrally shaped with the flexible element.

DESCRIPTION OF THE PREFERRED EMBODIMENTS

Figure 1:
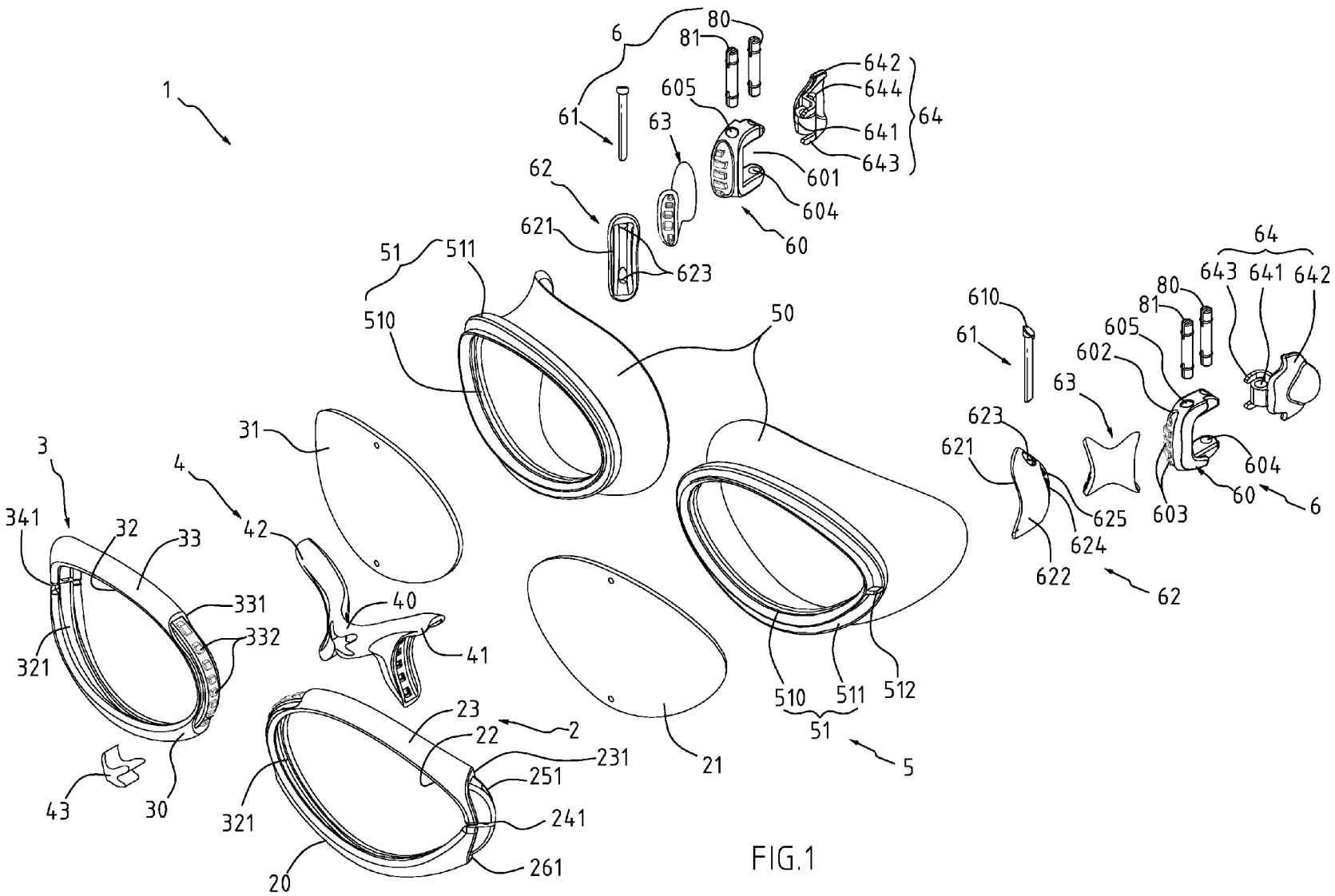
FIG. 1 is an exploded perspective view of swimming goggles of the present invention.

Referring to FIGS. 1 to 7, swimming goggles 1 of the present invention comprises left and right frame 2, 3, a connecting element 4 interconnecting the left and right frames 2, 3, padding portions 5, and buckling devices 6. The left and right frames 2, 3 respectively comprise clamping frames 20, 30 and lenses 21, 31. The clamping frames 20, 30 have inner and outer rims 22, 32 and outer rims 23, 33. The inner rims 22, 32 have clamping notches 221, 321 formed thereon for clamping and holding fixing portions 51 of the padding portions 5 which fix the lenses 21, 31. Cutout portions 231, 331 are defined at inner sides of the outer rims 22, 33 and face each other. The cutout portions 231, 331 have a plurality of protrusions 232, 332 protruding outwardly of the cutout portion 231, 331 for facilitating a better grip when being integrally shaped with the connecting element 4. Slits 241, 341 are formed at outer sides of the outer rims 23, 33 and transversely penetrate the outer rims 23, 33 and inner rims 22, 32 for enabling easily assembly with the fixing portions 51 of the padding portions 5. The outer sides of the outer rims 23, 33 define penetrating channels 251, 351 therein which penetrate the outer rims 23, 33 and the slits 241, 341 and are perpendicular to the slits 241, 341. Furthermore, recessed portions 261, 361 are formed at the outer sides of the outer rims 23, 33 in such a way that the recessed portions 261, 361 are transversely divided by the slits 241, 341.

The connecting element 4 is made of polycarbonate resin (PC) and has a central portion 40 and left and right portions 41, 42, wherein the central portion 40 is embedded with a radiant hard element 43 intended to reinforce strength of the connecting element 4. The left and right portions 41, 42 integrally cover the cutout portions 231, 331 of the clamping frames 20, 30, respectively. The connecting element 4 is flexible to fit to a user's nose bridge and makes the wearing more comfortable.

Each of the pudding portions 5 is made of thermal plastic rubber (TPR) and has a contact portion 50 and the fixing portion 51. The contact portion 50 integrally laterally extends from the fixing portion 51. The fixing portion 51 has an inner groove 510 and an outer lip portion 511, wherein the inner groove 510 is used to fix peripheries of the lenses 21, 31 therein, and the outer lip portion 511 is to be held in the clamping notches 221, 321 of the clamping frame 20, 30. Furthermore, protruding elements 512 are formed on the outer lip portions 511 and correspond to the slits 241, 341 for being jammed into the slits 241, 341 to provide a function of leak proof.

Figure 4:
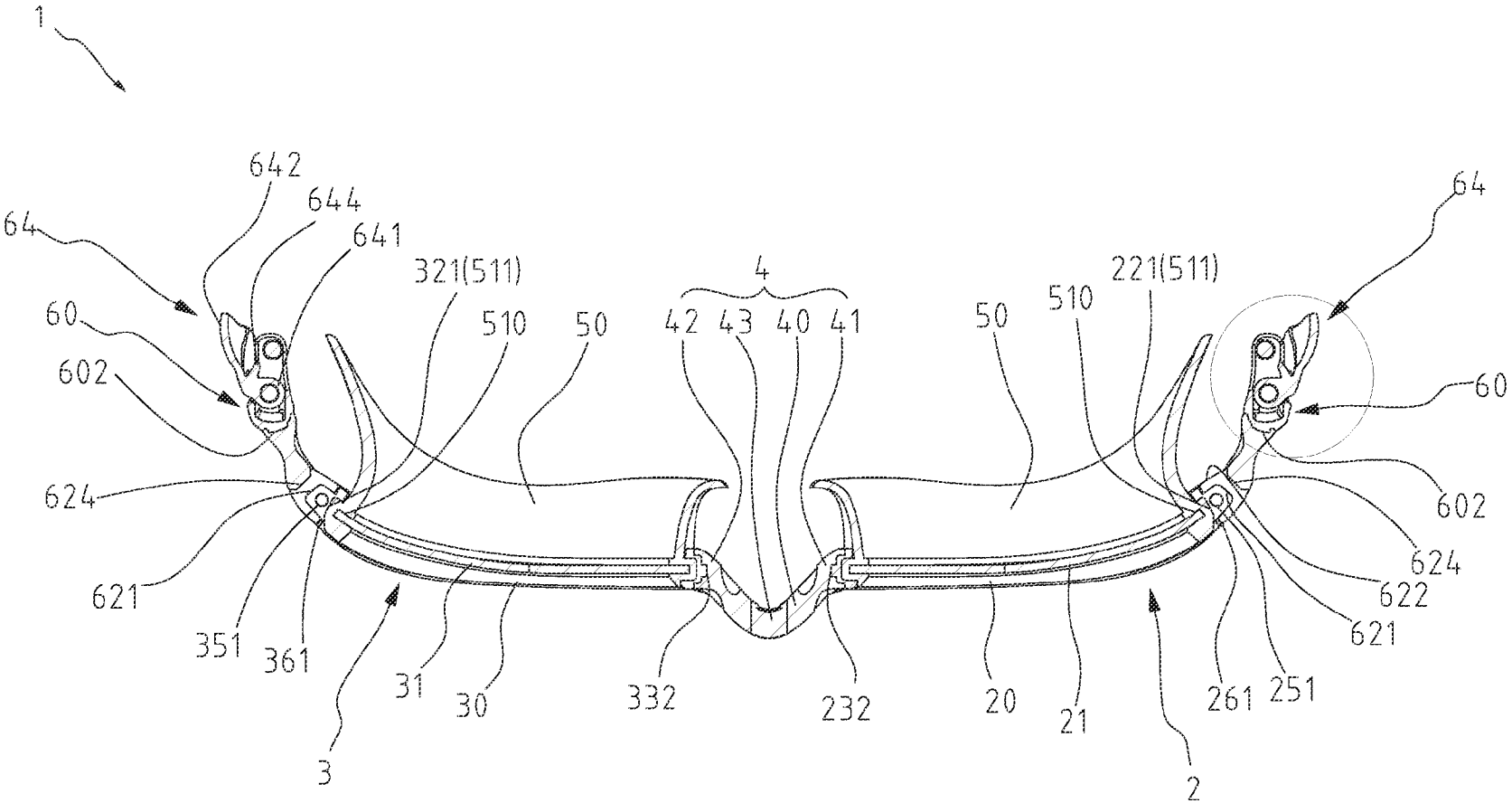
FIGS. 4 to 6 are cross-sectional views taken along the lines 4-4, 5-5, and 6-6 in FIG. 3, respectively.
Figure 5:
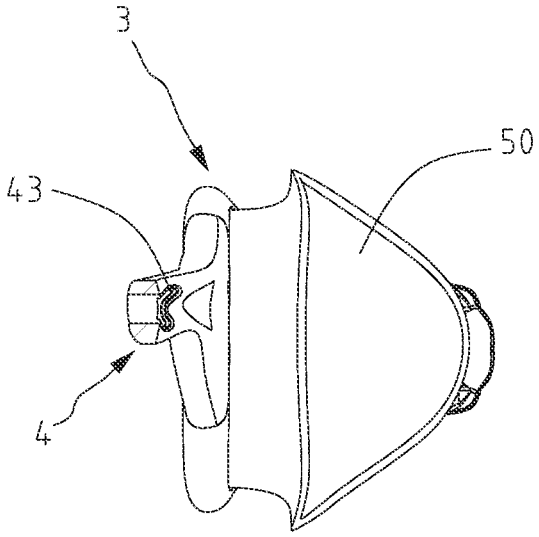
Figure 6:
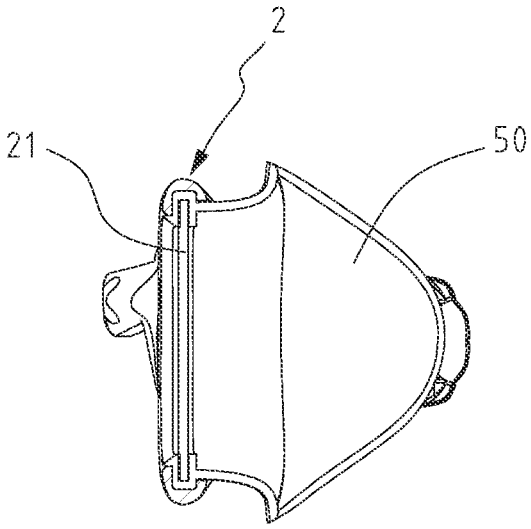
Figure 7:
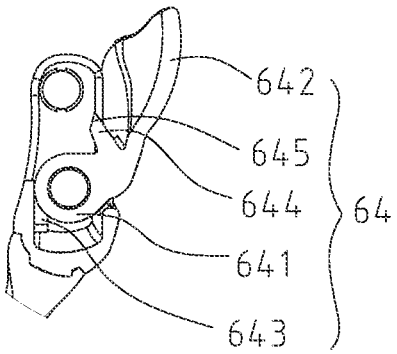
FIG. 7 is a partially enlarged view of a buckling device of FIG. 4.
Figure 8:
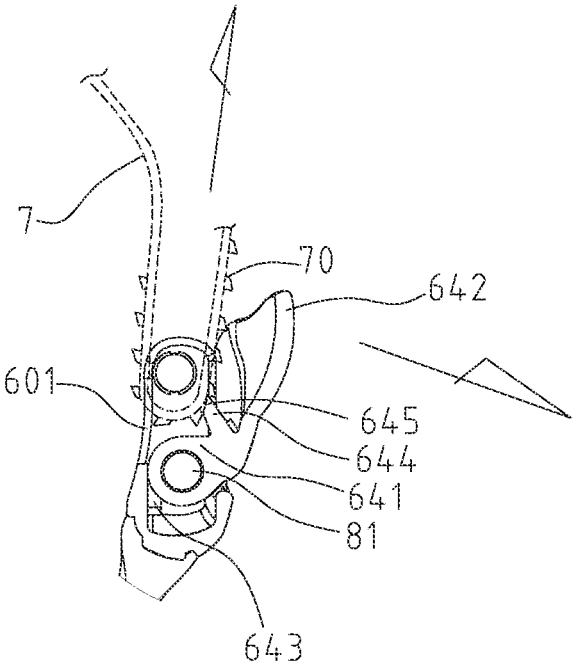
FIG. 8 is a schematic view illustrating the buckling device that is being pulled to disengage a head strap so as to adjust the head strap to be tightened or loosened.

Each of the buckling devices 6 comprises a buckling body 60, a first connecting element 61, a second connecting element 62, a flexible element 63 made of PC, and a buckling element 64. The buckling body 60 defines shaft holes 604 on opposite sides thereof where a shaft 80 is fixed in between the shaft holes 604 to define a guiding cavity 601 which allows a head strap 7 to pass through (as shown in FIG. 8). The head strap 7 has multiple retaining slots 70 formed at opposite end portions thereof. Further, a first dent portion 602 is formed at a side of the buckling body 60 facing the flexible element 63, and has a plurality of ribs 603 protruding outwardly for facilitating a better grip when being integrally shaped with the flexible element 63. In the preferable embodiment, the first connecting element 61 is a bolt having a bolt head 610 at a top thereof. The second connecting element 62 is shaped as a cap being hollow inside, and has inner and outer profiles 621, 622 and a through hole 623 which corresponds to the penetrating channels 251, 351 and penetrates the inner and outer profiles 621, 622. A size of the inner profile 621 of the cap 62 is slightly smaller than profiles of the recessed portion 26, 361 of the clamping frames 20, 30 (as shown in FIG. 4) so as to allow the cap 62 to be jammed onto the recessed portion and fixed by the first connecting element 61 that is inserted into the through hole 623 and the penetrating channel 251. After assembly, the outer profiles 622 of the caps 62 are in alignment with the outer rims 23, 33 of the clamping frames 20, 23. Each outer profile 622 defines a second dent portion 624 formed at a side of the cap 62 facing the flexible element 63. The second dent portion 624 has a plurality of ribs 625 protruding outwardly for facilitating a better grip when being integrally shaped with the flexible element 63.

Referring to FIGS. 1, 4 and 8, each of the buckling elements 64 comprises a pivoting base 641, an operation arm 642, a support arm 643, and an engaging arm 644. The pivoting base 641 is assembled with the buckling body 60 by a shaft 81 inserted into a shaft hole 605 formed on the bucking body 60 and the pivoting base 641. The operation arm 642 extends backwards from a side of the pivoting base 641. The support arm 643 is disposed at another side of the pivoting base 641 opposite to the operation arm 642, and props against the buckling body 60 in the guiding cavity 601 to function as a lever. The engaging arm 644 integrally extends from the operation arm 642 and has an engaging end 645 located within a path of the head strap 7 passed through the guiding cavity 601, wherein when the operation arm 642 is being pulled outwards, the engaging arm 644 moves outwards in conjunction with the operation arm 642 so as to disengage or engaged the retaining slots 70 of the head strap 7.

Figure 2:
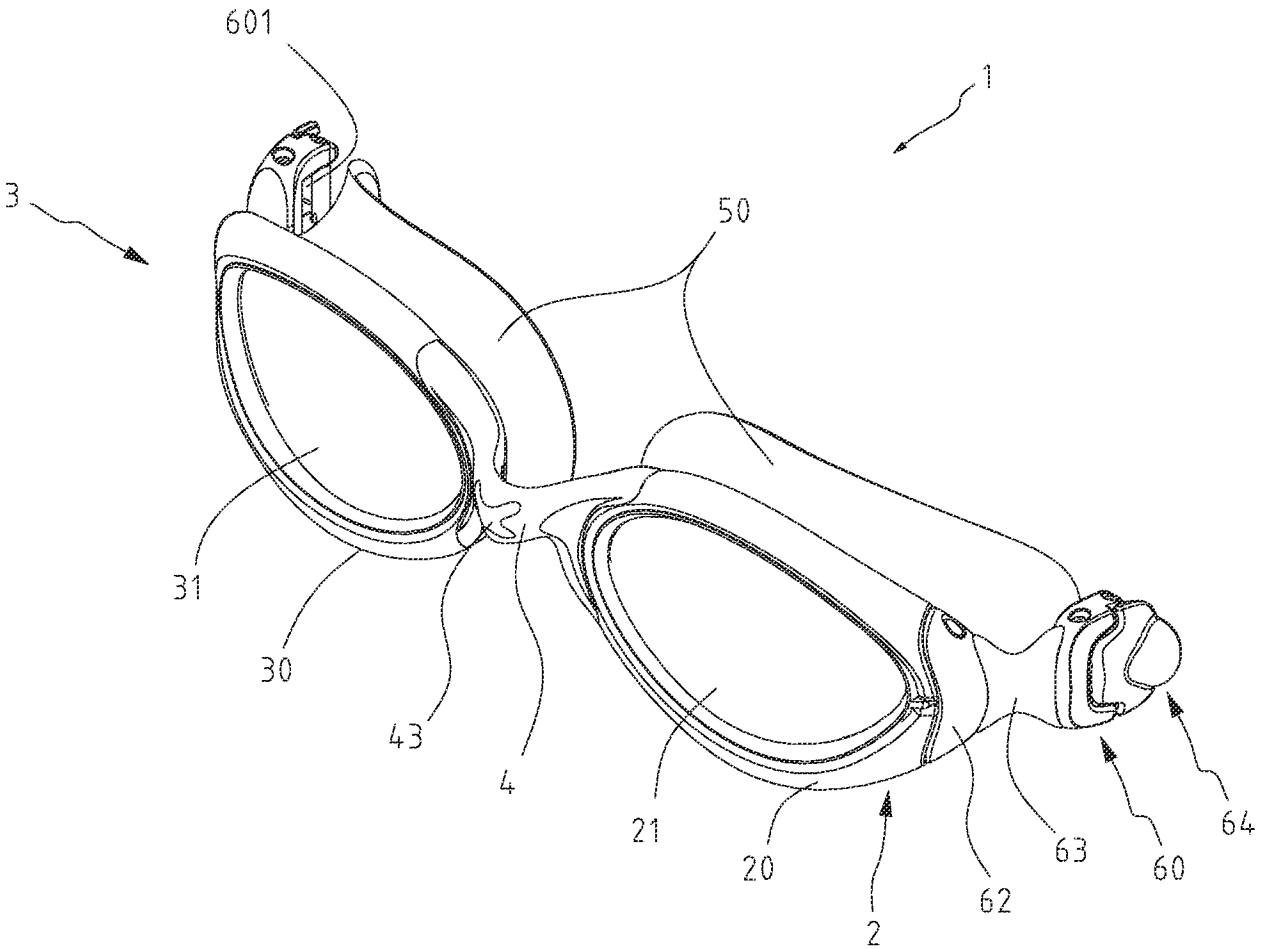
FIG. 2 is a perspective assembly view of FIG. 1.
Figure 3:
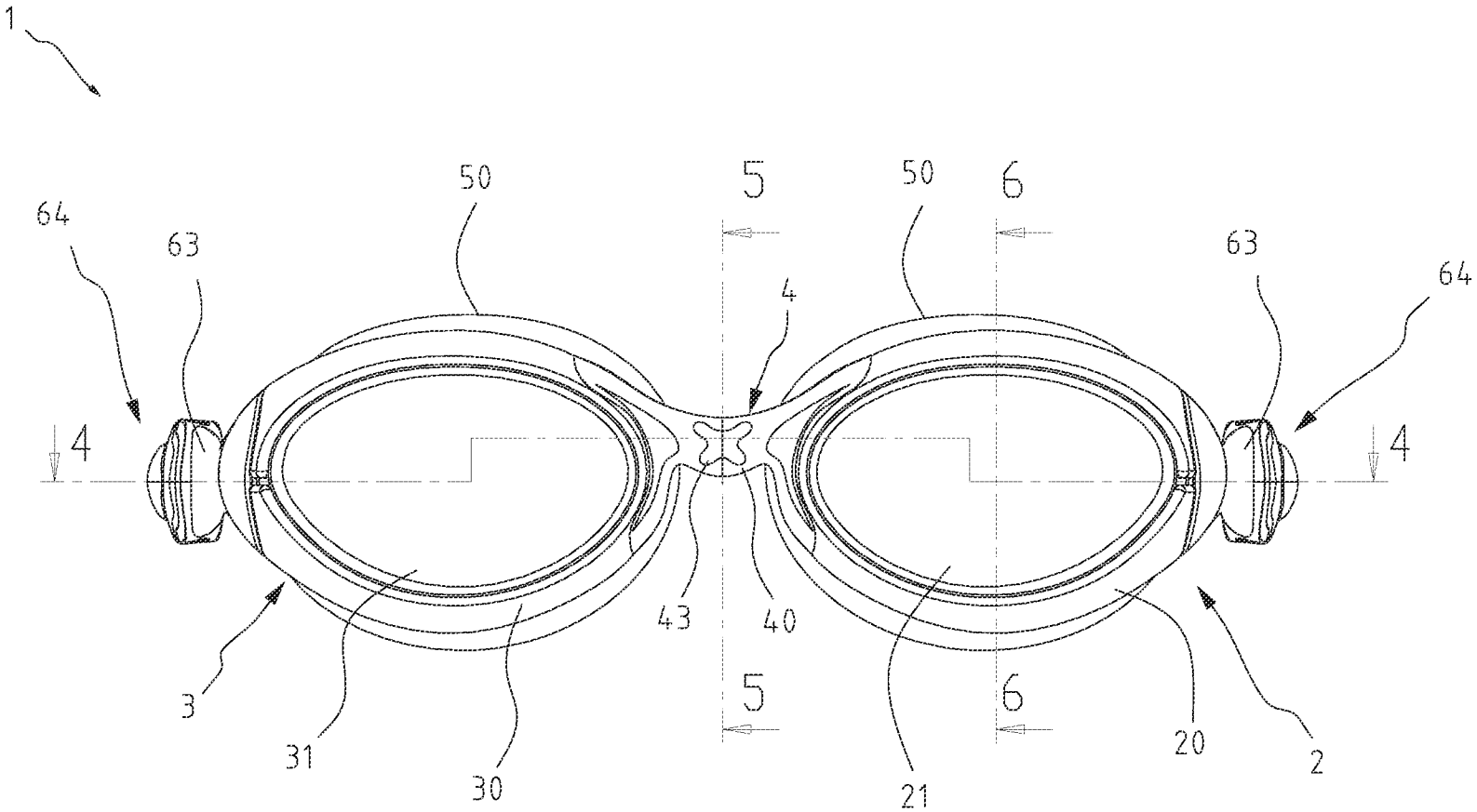
FIG. 3 is a front elevational view of the swimming goggles.

Referring to FIG. 1 in combination with FIG. 2, the swimming goggles 1 of the present invention is fabricated through an integral shaping technique, wherein the connecting element 4 is utilized to integrally cover the cutout portions 231, 331 of the clamping frames 20, 30 with the left and right portions 41, 42, whereby the left and right frames 2, 3 and the connecting element 4 are being assembled together. Likewise, by using the integral shaping technique the buckling body 60 is integrally shaped with the flexible element 63 so that the buckling device 6 is capable of being connected with the second connecting element 62 over the flexible element 63. In assembly of the swimming goggles 1, fix the lenses 21, 31 to the inner grooves 510 of the padding portions 5, respectively. After the lenses 21, 31 are fixed, cover the clamping frames 20, 30 onto the fixing portions 51 where the outer lip portions 511 are being held and clamped in the clamping notches 221, 321. Then, the buckling devices 6 are connected with the left and right frames 2, 3 by jamming the second elements 62 onto the recessed portions 261, 361 in combination with the insertion of the first elements 61 to further fix the second elements 62 to the clamping frames 20, 30. In this manner, the swimming goggles 1 are completely assembled.

The present invention utilizes flexibility of the left and right portions 41, 42 of the connecting element 4 to allow the connecting element 4 to be perfectly fitted to a user's nose bridge, and utilizes the flexible elements 63 to allow the buckling devices 6 to move in order to be appropriately located in adjacent to the user's temples. As a result, the swimming goggles 1 of the present invention is designed ergonomically and provide comfort in wearing. Furthermore, referring to FIG. 8, the engaging arm 644 moves in conjunction with the operation arm 642 when the operation arm 642 is being pulled outwardly, whereby disengaging the retaining slots 70 of the head strap 7 to allow the head strap 7 to be adjusted.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, comprising: left and right frames, a connecting element interconnecting the left and right frames, padding portions, and buckling devices respectively attached to outer sides of the left and right frames for connecting and guiding a head strap; wherein the left and right frames each comprises a clamping frame having an inner rim and an outer rim, a clamping notch formed on the inner rim, a cutout portion defined at an inner side of the outer rim, a slit formed at an outer side of the outer rim and transversely penetrating the outer and inner rims, and a penetrating channel defined on the outer side of the outer rim, the penetrating channel penetrating the outer rim and the slit and being perpendicular to the slit;

the connecting element having a central portion and left and right portions, the left and right portions integrally covering the cutout portions of the clamping frames, respectively;

each of the padding portions comprising a contact portion and a fixing portion, the contact portion integrally laterally extending from the fixing portion, the fixing portion having an inner groove for fixing a lens, and an outer lip portion for being held in the clamping notch of the clamping frame; and each of the buckling devices comprising a buckling body at least defining a guiding cavity thereon, a first connecting element inserted into the penetrating channel of the clamping frame, and a flexible element integrally connecting the left and right frames and the buckling body;

wherein the buckling device further comprises a second connecting element which is shaped as a cap being hollow inside, the cap having inner and outer profiles and a through hole which corresponds to the penetrating channel and penetrates the inner and outer profiles;

wherein recessed portions are formed at the outer sides of the outer rims of the clamping frames such that the recessed portions are transversely divided by the slits, wherein a size of the inner profile of the cap is slightly smaller than a profile of the recessed portion so as to allow the cap to be jammed onto the recessed portion and fixed by the first connecting element that is inserted into the through hole and the penetrating channel.

2. The swimming goggles of claim 1, wherein the cutout portion of the clamping frame has a plurality of protrusions protruding outwardly of the cutout portion for facilitating a better grip when being integrally shaped with the left and right portions of the connecting element.

3. The swimming goggles of claim 1, wherein a first dent portion is formed at a side of the buckling body facing the flexible element, and has a plurality of ribs protruding outwardly for facilitating a better grip when being integrally shaped with the flexible element.

4. The swimming goggles of claim 1, wherein the first connecting element of the buckling device is a bolt having a bolt head at a top thereof.

5. The swimming goggles of claim 4, wherein the outer profile of the cap is in alignment with the outer rim of the clamping frame, and has a second dent portion formed at a side of the cap facing the flexible element, the second dent portion having a plurality of ribs protruding outwardly for facilitating a better grip when being integrally shaped with the flexible element.

6. The swimming goggles of claim 1, wherein each of the buckling devices further comprises a buckling element pivotally coupled to the buckling body, the buckling element has a pivoting base pivotally disposed in the guiding cavity, an operation arm, a support arm, and an engaging arm, wherein the operation arm extends from a side of the pivoting base, the support arm is disposed at another side of the pivoting base opposite to the operation arm, and the engaging arm integrally extends from the operation arm and has an engaging end located within a path of the head strap passed through the guiding cavity.

7. The swimming goggles of claim 6, wherein the head strap has multiple retaining slots formed at opposite end portions of the head strap, and the engaging arm is engageable with the retaining slot.

8. The swimming goggles of claim 7, wherein a protruding element is formed on the outer lip portion of the padding portion corresponding to the slit of the clamping frame.

9. The swimming goggles of claim 8, wherein the central portion of the connecting element is embedded with a radiant hard element intended to reinforce strength of the connecting element.

* * * * *